US008349201B2

(12) United States Patent
Yang et al.

(10) Patent No.: US 8,349,201 B2
(45) Date of Patent: Jan. 8, 2013

(54) PROCESSING METHOD FOR SOI SUBSTRATE

(75) Inventors: Chung-Mo Yang, Ansan-si (KR); Jae-Woo Joung, Suwon-si (KR); Young-Seuck Yoo, Seoul (KR)

(73) Assignee: Samsung Electro-Mechanics Co., Ltd., Gyunggi-Do (KR)

( * ) Notice: Subject to any disclaimer, the term of this patent is extended or adjusted under 35 U.S.C. 154(b) by 365 days.

(21) Appl. No.: 12/762,966

(22) Filed: Apr. 19, 2010

(65) Prior Publication Data

US 2011/0111600 A1 May 12, 2011

(30) Foreign Application Priority Data

Nov. 12, 2009 (KR) ..... 10-2009-0109052

(51) Int. Cl.
*B44C 15/00* (2006.01)

(52) U.S. Cl. ..... 216/58; 435/309.1; 347/47

(58) Field of Classification Search ..... None
See application file for complete search history.

(56) References Cited

U.S. PATENT DOCUMENTS

2004/0058438 A1* 3/2004 Fujii et al. ..... 435/309.1
2009/0294803 A1* 12/2009 Nuzzo et al. ..... 257/213

FOREIGN PATENT DOCUMENTS

JP 2007187608 A 7/2007
JP P4182921 B2 9/2008

OTHER PUBLICATIONS

Lee et al, Large-area, selective transfer of microstructured silicon: a printing-based approach to high-performance thin-film transistors supported on flexible substrates, Aug. 22, 2005, Advanced Materials, Adv. Mater. 2005, 17, p. 2332-2336.*
Japanese Office Action, and partial English translation thereof, issued in Japanese Patent Application No. 2010-113399 dated Jun. 19, 2012.

* cited by examiner

*Primary Examiner* — Binh X Tran
*Assistant Examiner* — David Cathey, Jr.
(74) *Attorney, Agent, or Firm* — McDermott Will & Emery LLP

(57) ABSTRACT

A method of processing a SOI substrate to form a groove in the SOI substrate in which a silicon layer is stacked on both sides of an oxide layer is disclosed. In accordance with an embodiment of the present invention, the method includes dividing a portion of the silicon layer, in which the groove is to be processed, into a plurality of unit portions, performing dry etching on certain portions of the plurality of divided unit portions such that the oxide layer is exposed and removing remaining portions of the plurality of divided unit portions by removing the oxide layer.

3 Claims, 7 Drawing Sheets

PROCESSING METHOD FOR SOI SUBSTRATE

CROSS-REFERENCE TO RELATED APPLICATIONS

This application claims the benefit of Korean Patent Application No. 10-2009-0109052, filed with the Korean Intellectual Property Office on Nov. 12, 2009, the disclosure of which is incorporated herein by reference in its entirety.

BACKGROUND

1. Technical Field

The present invention is related to a method of processing an SOI substrate.

2. Description of the Related Art

If a MEMS process is used to manufacture an inkjet head, it is needed to form a layer including an ink channel. The ink channel takes up a relatively large portion of a silicon wafer. To form the ink channel in the silicon wafer, a deep reactive ion etching (DRIE) method is widely used.

However, if a channel having a large area is formed by using a reactive ion etching (RIE) device, a sectional profile in the wafer becomes non-uniform after performing an etching process. That is, as illustrated in FIG. 1, the pattern processed in a middle plate of the inkjet head in which a reservoir is formed occupies a relatively large portion of the wafer, and thus the profile of a side wall becomes larger than an angle of 90 degrees during the DRIE process, thereby forming a shape as shown in FIG. 1.

In other words, the shape actually processed is different from the originally designed shape, and thus if an inkjet head is completed by coupling top, middle and bottom plates to one another, the contact surfaces between the three plates may be misaligned.

SUMMARY

The present invention provides a method of processing an SOI substrate that can secure a stable profile even in case a groove having a large area is processed in the SOT substrate.

An aspect of the present invention provides a method of processing an SOI substrate to form a groove in the SOI substrate in which a silicon layer is stacked on both sides of an oxide layer. In an embodiment of the present invention, the method includes dividing a portion of the silicon layer, in which the groove is to be processed, into a plurality of unit portions, performing dry etching on certain portions of the plurality of divided unit portions such that the oxide layer is exposed and removing remaining portions of the plurality of divided unit portions by removing the oxide layer.

The dividing of a portion of the silicon layer and the performing of a dry etching can be performed in such a way that the remaining portions have a mesh-like shape.

The SOI substrate can constitute an inkjet head, and the groove can be any one of a reservoir, a pressure chamber and an ink channel.

The removing of remaining portion can be performed by way of wet etching.

Additional aspects and advantages of the present invention will be set forth in part in the description which follows, and in part will be obvious from the description, or may be learned by practice of the invention.

DETAILED DESCRIPTION

Figure 1:
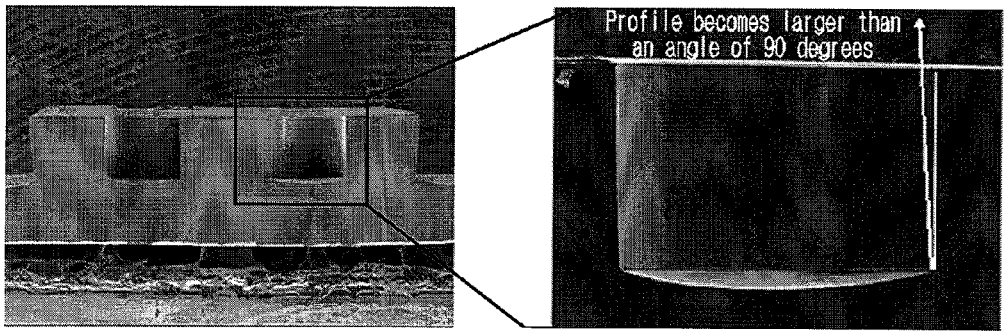
FIG. 1 PRIOR ART
FIG. 1 is photographs showing a silicon wafer that is processed in accordance with the related art.

As the invention allows for various changes and numerous embodiments, a particular embodiment will be illustrated in the drawings and described in detail in the written description. However, this is not intended to limit the present invention to a particular mode of practice, and it is to be appreciated that all changes, equivalents, and substitutes that do not depart from the spirit and technical scope of the present invention are encompassed in the present invention. In the description of the present invention, certain detailed explanations of related art are omitted when it is deemed that they may unnecessarily obscure the essence of the invention.

A method of processing an SOI substrate in accordance with a certain embodiment of the present invention will be described in more detail through the below description with reference to the accompanying drawings. Those components that are the same or are in correspondence are rendered the same reference numeral regardless of the figure number, and redundant descriptions are omitted.

Figure 2:
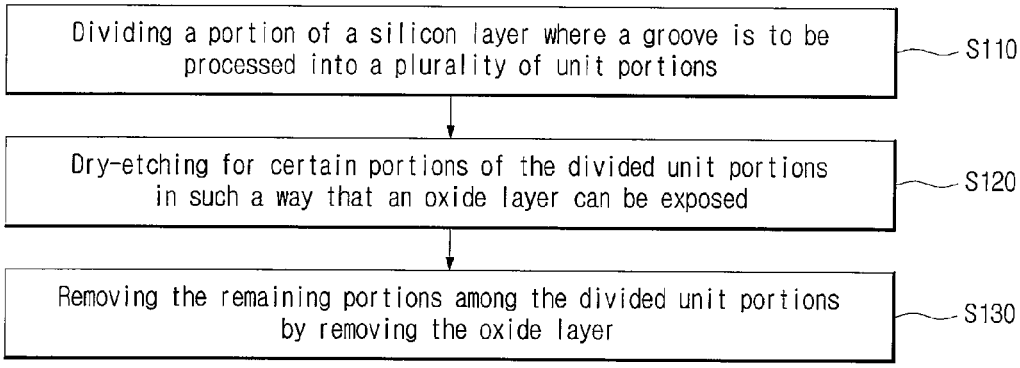
FIG. 2 is a flowchart illustrating a method of processing an SOI substrate in accordance with an embodiment of the present invention.

FIG. 2 is a flowchart illustrating a method of processing an SOI substrate in accordance with an embodiment of the present invention, and FIGS. 3 to 6 illustrate each respective process of processing an SOI substrate in accordance with an embodiment of the present invention.

An SOI substrate 10 has a structure in which silicon layers 12 and 13 are stacked on either side of an oxide layer 11. The SOI substrate 10 is used in the manufacturing of a structure such as an inkjet head because of the physical/chemical properties of silicon and the functionality of the oxide layer 11, positioned in the center, as an etching barrier. To form a structure such as an inkjet head, however, it is required that processing the SOI substrate 10, more specifically the silicon layer 13 of the SOI substrate 10, be performed, but if a groove 13*c* having a large area is processed, the profile of an inner wall of the silicon layer 13 can become poor.

Figure 3:
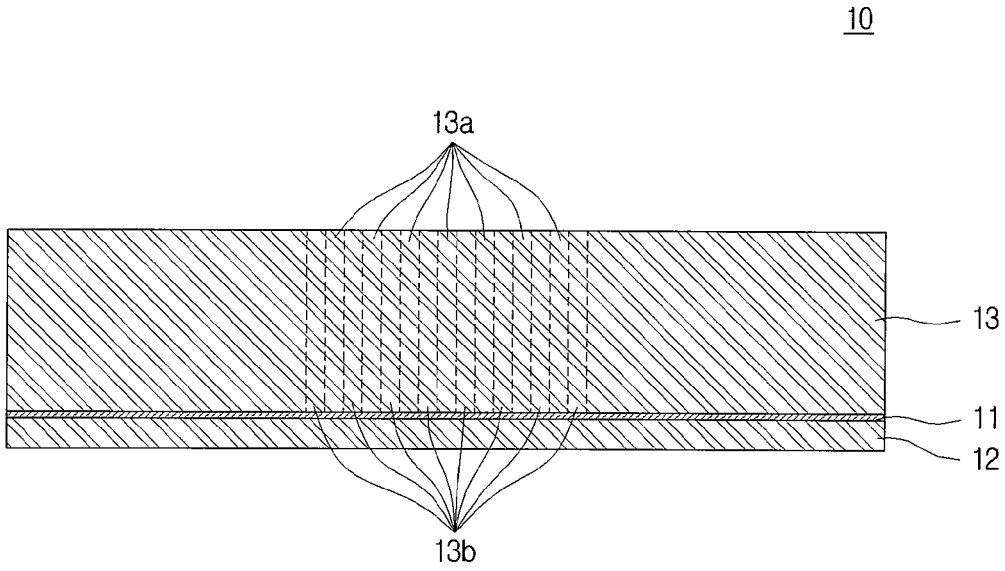
FIGS. 3 to 6 illustrate each respective process of processing an SOI substrate in accordance with an embodiment of the present invention.

To solve this problem, in the present embodiment, a portion of the silicon layer 13 of the SOI substrate 10 where the groove 13*c* is to be processed is first divided into a plurality of unit portions 13*a* and 13*b* (S110). That is, as illustrated in FIG. 3, a large area that is to be processed and removed can be divided into the plurality of smaller unit portions 13*a* and 13*b*. It is to be noted here that the meaning of dividing encompasses not only physically dividing the large area but also dividing the large area into the plurality of unit portions 13*a* and 13*b* through the use of virtual partition lines.

Figure 4:
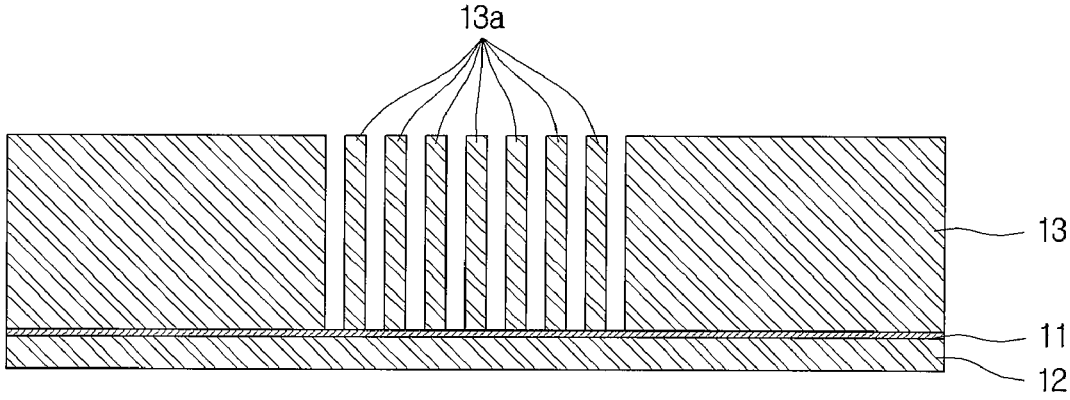
Figure 5:
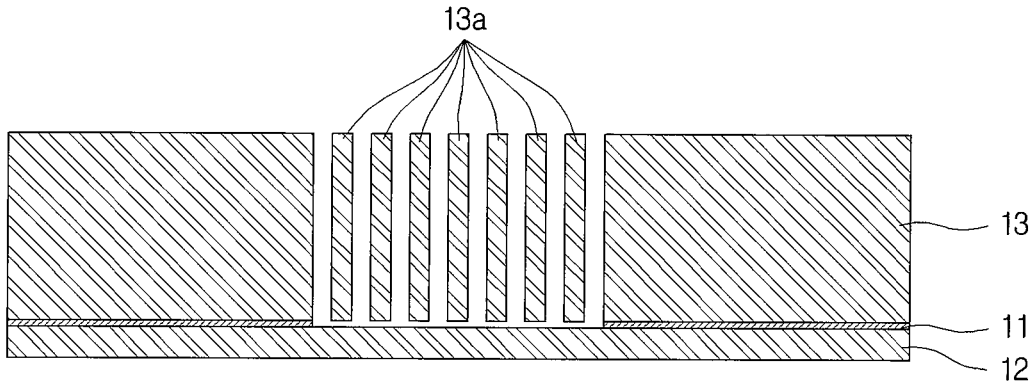

Next, dry etching is performed for certain portions 13*b* of the divided unit portions 13*a* and 13*b* in such a way that the oxide layer 11 can be exposed (S120). That is, as illustrated in FIG. 4, dry etching is performed only for certain portions 13*b* (shown in FIG. 3) of the partitioned unit portions so that the oxide layer 11 of the SOI substrate 10 can be exposed through the removed portion. To selectively perform dry etching only on the certain portions 13*b*, a mask that selectively opens corresponding portions only can be stacked on the upper surface of the SOI substrate 10, and then dry etching using plasma can be processed.

Here, the remaining portions 13*a* can have a mesh-like shape. If the remaining portions 13*a* have a mesh-like shape, the density of plasma can be distributed, thereby speeding up the etching rate.

Then, the remaining portions 13*a* among the divided unit portions are removed by removing the oxide layer 11 (S130). The oxide layer 11 where the groove 13*c* is to be processed can be completely removed through the portions of the oxide layer 11 exposed in the previous process. To remove the oxide layer 11, a wet etching process using an etching solution can be used. This, however, is by no means to restrict the present invention to this particular method, and there can be other various methods as long as the entire oxide layer 11 where the groove 13*c* is to be processed can be removed.

Figure 6:
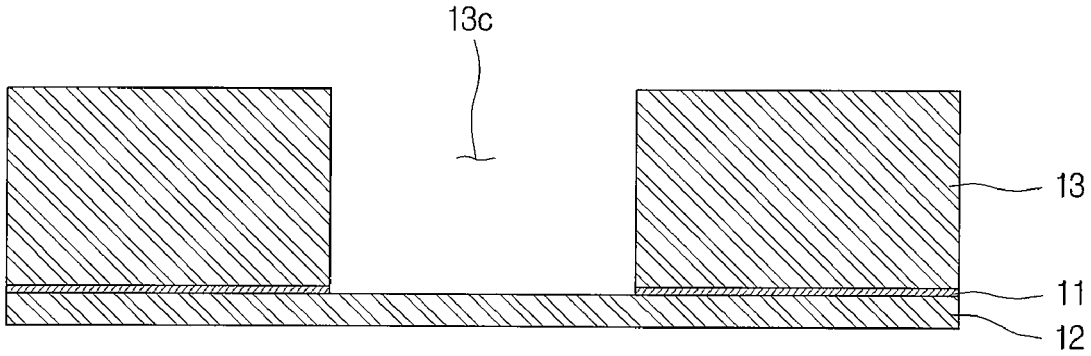

Once the oxide layer 11 is removed, the remaining portions 13*a* of the silicon layer 13 on the oxide layer 11 can be also separated and removed from the SOI substrate 10. Once the remaining portions 13*a* of the silicon layer 13 are removed, the processing of the groove 13*c* can be completed, as illustrated in FIG. 6.

The method of processing the SOI substrate 10, which has been described above, can be used in manufacturing an inkjet head in which a plurality of SOI substrates are stacked on one another. In other words, a plurality of SOI substrates can be prepared, and then a reservoir, a pressure chamber and/or an ink channel can be processed in each of the plurality of SOI substrates by using the processing method described above. Then, the completed SOI substrates can be stacked to one another to manufacture an inkjet head.

Figure 7:
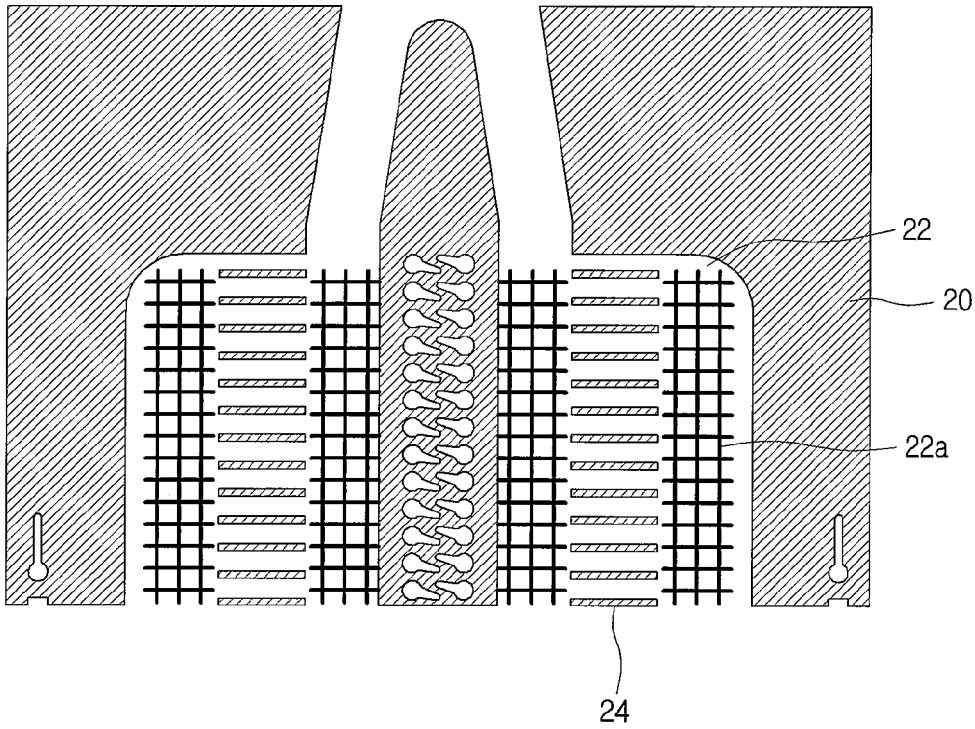
FIG. 7 illustrates a layer of an inkjet head in which a method of processing an SOI substrate in accordance with an embodiment of the present invention is applied.

FIG. 7 illustrates an SOI substrate 20 having a reservoir 22 formed therein where the processing method described above is applied. That is, FIG. 7 illustrates that a portion where the reservoir 22 is to be formed is divided into a plurality of unit portions, and then some portions among the divided unit portions are removed first. FIG. 7 illustrates residual portions 22*a* having a mesh-like shape. The reference numeral 24 of FIG. 7 represents separators 24 that partition an ejecting cell for ejecting a droplet of ink.

In the processing method described above, a large-area portion to be processed can be divided into unit portions with small areas, and then the unit portions are successively processed. In this way, the quality of an inner wall of the portion to be processed can be secured, and a structure close to the designed structure can be implemented, thereby making the product quality more stable.

In one possible embodiment of the present invention, a stable profile can be secured even in case a groove having a large area is processed in an SOI substrate.

While the spirit of the present invention has been described in detail with reference to a particular embodiment, the embodiment is for illustrative purposes only and shall not limit the present invention. It is to be appreciated that those skilled in the art can change or modify the embodiment without departing from the scope and spirit of the present invention.

As such, many embodiments other than that set forth above can be found in the appended claims.

What is claimed is:

1. A method of processing a silicon-on-insulator (SOI) substrate to form a groove in the SOI substrate in which a silicon layer is stacked on both sides of an oxide layer, the method comprising steps of:

dividing a portion of the silicon layer, in which the groove is to be formed, into a plurality of unit portions;

performing dry etching on certain portions of the plurality of divided unit portions such that the oxide layer is exposed; and removing remaining portions of the plurality of divided unit portions by removing the oxide layer, wherein the SOI substrate constitutes an inkjet head, and the groove is any one of a reservoir, a pressure chamber, and an ink channel.

2. The method of claim 1, wherein the steps of dividing a portion of the silicon layer and performing dry etching are performed in such a way that the remaining portions have a pattern with missing regions of repeatedly shaped openings.

3. The method of claim 1, wherein the step of removing remaining portions is performed by wet etching.

* * * * *